US006933650B2

(12) United States Patent
Wang

(10) Patent No.: US 6,933,650 B2
(45) Date of Patent: Aug. 23, 2005

(54) WEAR INDICATOR

(75) Inventor: Yongfeng Wang, Suzhou (CN)

(73) Assignee: Positec Power Tools (Suzhou) Co., Ltd., Suzhou (CN)

( * ) Notice: Subject to any disclaimer, the term of this patent is extended or adjusted under 35 U.S.C. 154(b) by 0 days.

(21) Appl. No.: 10/754,274

(22) Filed: Jan. 9, 2004

(65) Prior Publication Data

US 2004/0155553 A1 Aug. 12, 2004

(30) Foreign Application Priority Data

Jan. 14, 2003 (CN) ..... 03112700 A

(51) Int. Cl.[7] ..... H01R 39/58

(52) U.S. Cl. ..... 310/245; 310/68 B; 310/239; 310/242

(58) Field of Search ..... 310/238–239, 310/242–249, 251, 68 B

(56) References Cited

U.S. PATENT DOCUMENTS 3,924,147 A * 12/1975 Tarnow et al. ..... 310/68 R
4,024,525 A * 5/1977 Baumgartner et al. ..... 340/648
4,344,009 A * 8/1982 Reynolds ..... 310/242
5,509,625 A * 4/1996 Oullette et al. ..... 244/134 D

FOREIGN PATENT DOCUMENTS

JP 58009552 A * 1/1983
JP 61142943 A * 6/1986
JP 10257735 A * 9/1998

* cited by examiner

*Primary Examiner*—Burton Mullins
(74) *Attorney, Agent, or Firm*—Workman Nydegger

(57) ABSTRACT

The present invention relates to a wear indicator for a motor carbon brush which includes a housing, carbon brushes, an elastic element, a circuit board with an alarm indicator light and an electric probe disposed on the circuit board. The electric probe is connected to the alarm indicator light and the carbon brush has a contact portion on its outer surface which when the brush is worn and need to be changed is electrically connected to the alarm indicator light through the electrical probe to turn the alarm indicator light on. The present invention is simple to manufacture and gives a indication of wear.

23 Claims, 5 Drawing Sheets

WEAR INDICATOR

CROSS-REFERENCE TO RELATED APPLICATIONS

The present application claims priority to China Patent Application No. 03112700.2 filed on Jan. 14, 2003 which is incorporated herein by specific reference.

BACKGROUND OF THE INVENTION

1. The Field of the Invention

The present invention relates to a wear indicator for a motor carbon brush and to a commutator motor comprising one or more of the wear indicators.

2. The Relevant Technology

A conventional commutator motor includes a housing, a carbon brush which is slidably mounted within the housing and at least one alarm indicator light. An end of the carbon brush bears against an elastic element and the other end contacts the round surface of the commutator. The carbon brush is biased against the commutator by means of the elastic element. A wire is embedded in the carbon brush in order to detect the wear degree to ensure that the carbon brush is timely replaced. When the carbon brush is worn and slides to a predetermined position, the wire is exposed and turns the alarm indicator light on. Generally such a carbon brush with an embedded wire is complicated to manufacture.

Another conventional arrangement incorporates an opening at a predetermined position of the carbon brush. A lighting element is disposed on one side of the carbon brush and a receiving element on the other side. When the carbon brush is worn and slides to a predetermined position, the receiving element receives through the opening the light emitted by the lighting element and turns the alarm indicator light on. A disadvantage of this arrangement is that the opening may become blocked (e.g., by dust) which interrupts the light making the alarm ineffective.

SUMMARY OF THE INVENTION

It is an object of the present invention to provide a simple and reliable wear indicator for a motor carbon brush Thus viewed from one aspect the present invention provides a wear indicator for a motor carbon brush including:

a housing;

a carbon brush slidably mounted within the housing, wherein the front end of the carbon brush touches the surface of the commutator and the surface of the carbon brush has a contact portion;

an elastic element positioned on the housing which bears against the rear end of the carbon brush;

a circuit board which is equipped with an alarm indicator light and is fixed to the housing;

an electric probe disposed on the circuit board which is electrically connected to the alarm indicator light, wherein in use when the carbon brush is in a first operational state, a surface of the electric probe is disconnected from the contact portion of the carbon brush and when the carbon brush is in a second operational state, the surface of the electric probe touches the contact portion of the carbon brush.

The present invention relates to a wear indicator for a motor carbon brush comprising: a housing and a carbon brush which is slidably mounted within the housing. An elastic element is positioned on the housing and is biased against the rear end of the carbon brush. A circuit board with an alarm indicator light is fixed to the housing. A front end portion of the carbon brush contacts the round surface of the commutator. The circuit board is equipped with an electric probe which is electrically connected to the alarm indicator light. The carbon brush surface has a contact portion such that when the carbon brush is in the first operational state, the surface (e.g., end) of the electric probe is disconnected from the contact portion on the carbon brush and the circuit which is made up of the carbon brush, electric probe and alarm indicator light in series is incomplete so that the alarm indicator light is switched off. When the carbon brush is in the second operational state, the surface (e.g., end) of the electric probe contacts the contact portion on the carbon brush and the circuit which is made up of the carbon brush, electric probe and alarm indicator light in series is complete so that the alarm indicator light is turned on.

The present invention exploits the conductive character of the carbon brush by providing a continuously exposed contact portion on the carbon brush to which the alarm indicator light may be electrically connected through an electric probe. When the brush is worn and needs to be changed, the electrical connection is made and the alarm indicator light is turned on. The present invention is reliable and simple to manufacture.

Preferably the contact portion (and/or the surface of the electric probe which it contacts) is arced.

Preferably the contact portion is continuously exposed.

Preferably the circuit board is a substantially planar body and the electric probe takes the form of a substantially columnar or angular projection from the planar body, wherein the substantially columnar or angular projection and the contact portion are capable of relative movement from the first operational state to the second operational state. Typically the substantially columnar or angular projection is static and the carbon brush moves between the first and second operational state as it wears. The position of the carbon brush in the second operational state can be predetermined to coincide with a position in which the carbon brush is worn to a degree which requires its replacement.

In a preferred embodiment, the wear indicator further comprises: an elongate truncated slot disposed on the surface of the carbon brush, wherein the contact portion is disposed at the end of the elongate truncated slot (e.g., the end wall).

In a preferred embodiment, the carbon brush is slidably mounted within the housing in a sliding direction and the wear indicator further comprises: an elongate truncated slot disposed on the surface of the carbon brush which extends co-directionally with the sliding direction, wherein the contact portion is an end portion of the elongate truncated slot (e.g., the end wall) and the electric probe takes the form of an angular projection from the planar body whose end is inserted freely into the elongate truncated slot.

Particularly preferably the angular projection has an arced end surface opposing the end portion, wherein in use when the carbon brush is in the second operational state, the arced end surface contacts the end portion of the elongate truncated slot.

Particularly preferably the end portion of the elongate truncated slot is arced.

The angular projection may take any suitable form. For example, the angular projection may be comprise a main body from which is angularly dependent an arm which extends into the elongate truncated slot. The main body may project from the planar body be twin legs.

The housing will typically have an elongate slot coincident with the elongate truncated slot in the carbon brush.

Alternatively preferably the contact portion is a protrusion protruding from the surface of the carbon brush.

Particularly preferably the carbon brush is slidably mounted within the housing in a sliding direction and the wear indicator further comprises: a guiding slot in the housing which extends co-directionally with the sliding direction, wherein the protrusion protrudes through the guiding slot and wherein the electric probe takes the form of a substantially columnar projection from the planar body.

Particularly preferably the substantially columnar projection has an arced surface opposing a contact surface of the protrusion wherein in use when the carbon brush is in the second operational state, the arced surface contacts the contact surface of the protrusion.

Particularly preferably the contact surface of the protrusion is arced.

Alternatively preferably the contact portion is an electrically conductive protrusion protruding from the surface of the carbon brush whose root is embedded in the carbon brush.

Particularly preferably the carbon brush is slidably mounted within the housing in a sliding direction and the wear indicator further comprises: a guiding slot in the housing which extends co-directionally with the sliding direction, wherein the electrically conductive protrusion protrudes through the guiding slot and wherein the electric probe takes the form of a substantially columnar projection from the planar body.

Particularly preferably the substantially columnar projection has an arced surface opposing a contact surface of the electrically conductive protrusion wherein in use when the carbon brush is in the second operational state, the arced surface contacts the contact surface of the electrically conductive protrusion.

Particularly preferably the contact surface of the electrically conductive protrusion is arced.

Viewed from a further aspect the present invention provides a commutator motor comprising one or more wear indicators as defined hereinbefore.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 3:
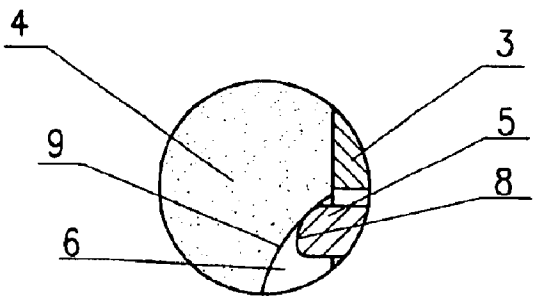
FIG. 3 shows an enlarged sectional view of A in FIG. 2.
Figure 2:
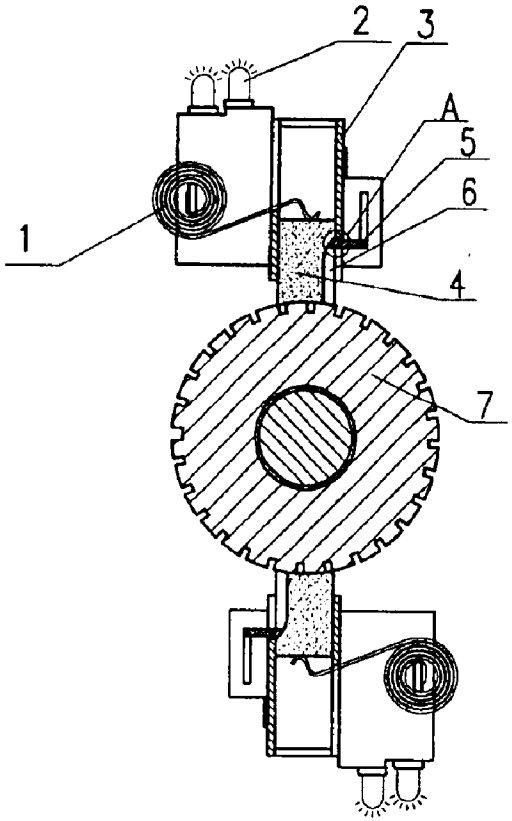
FIG. 2 shows a sectional view of the carbon brush in the second operational state.
Figure 1:
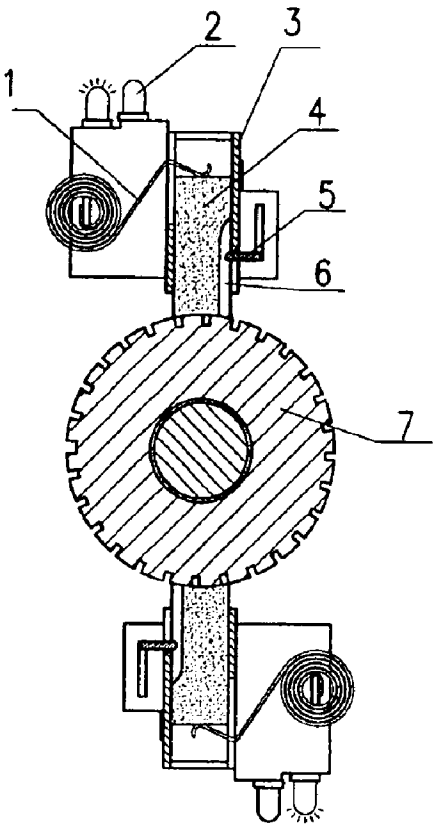
FIG. 1 shows a sectional view of a first embodiment of the invention with the carbon brush in the first operational state.
Figure 4:
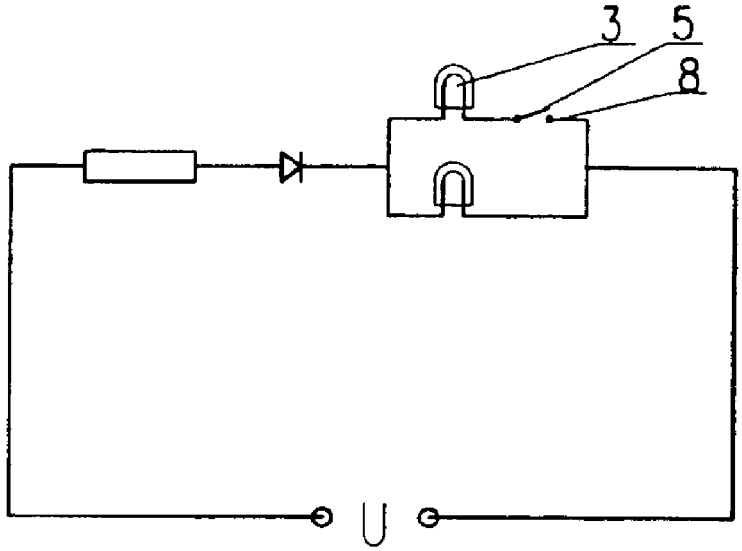
FIG. 4 is the alarm indicator circuit diagram.

FIGS. 1–9 illustrate a wear indicator for a carbon brush including a housing 3 and a carbon brush 4 which is slidably mounted within the housing 3. A torsion spring 1 is positioned on the housing 3 and bears against the rear end of the carbon brush 4. The front end of the carbon brush 4 touches the round surface of a commutator 7 and the surface of the carbon brush 4 has a contact portion. A planar circuit board 13 which is equipped with an alarm indicator light 2 is fixed to the housing 3. On the circuit board 13 is disposed an electric probe 5 which is electrically connected to the alarm indicator light 2. When the carbon brush 4 is in a first operational state, an end surface of the electric probe 5 is disconnected from the contact portion. When the carbon brush 4 is in a second operational state, the end surface of the electric probe 5 touches the contact portion of the carbon brush 4. Embodiments having three different contact portions are described below.

In the first embodiment (FIGS. 1–7), an elongate truncated slot 6 is disposed on the surface of the carbon brush 4 which extends in the sliding direction of the carbon brush 4. The electric probe 5 takes the form of an angular projection freely insertable into the elongate truncated slot 6. The contact portion is an end wall 9 of the elongate truncated slot 6 which is arced (see FIG. 3). The electric probe 5 has an arced end surface 8 opposing the arced end wall 9 (i.e., an end surface 8 arced in a direction opposite to the direction of travel of the carbon brush). When the carbon brush 4 is in the first operational state, the arced end surface 8 slides freely in the slot and the alarm indicator remains unlit. When the carbon brush 4 is in the second operational state, the arced end surface 8 touches the arced end wall 9 of the carbon brush 4 (see FIG. 3) and the alarm indicator light 2 is switched on.

Figure 5:
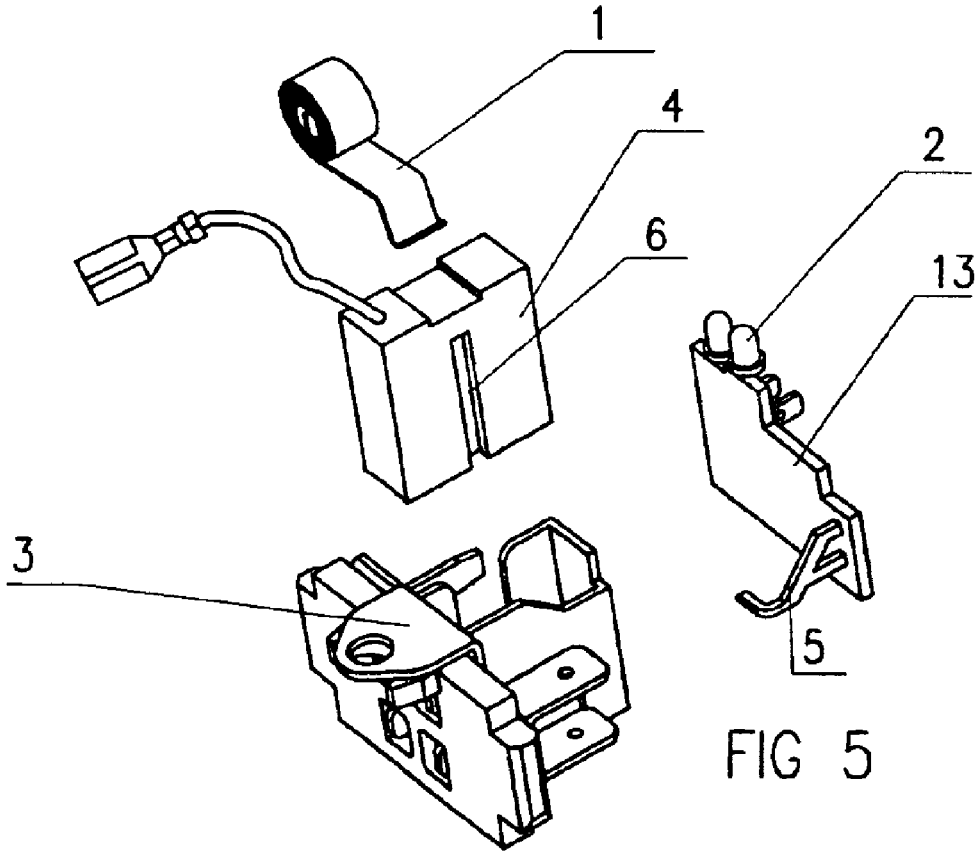
FIG. 5 shows an exploded view of the embodiment.
Figure 7:
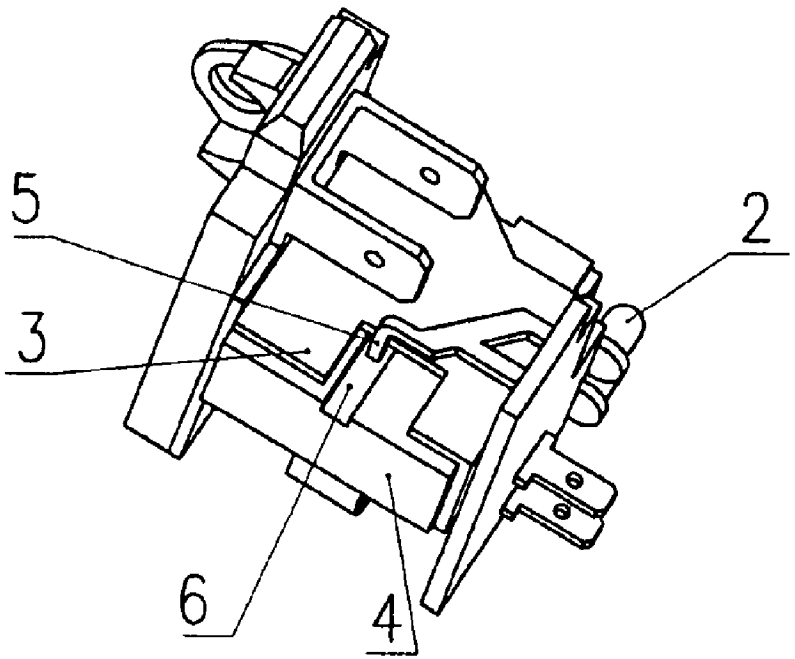
FIG. 7 shows a perspective view of the first embodiment from a second angle.
Figure 6:
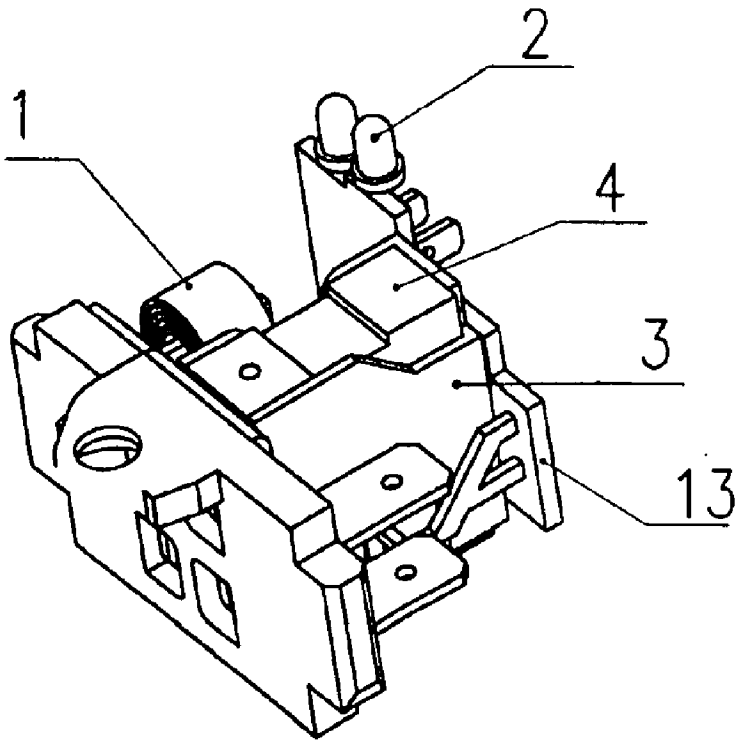
FIG. 6 shows a perspective view of the first embodiment from a first angle.
Figure 8:
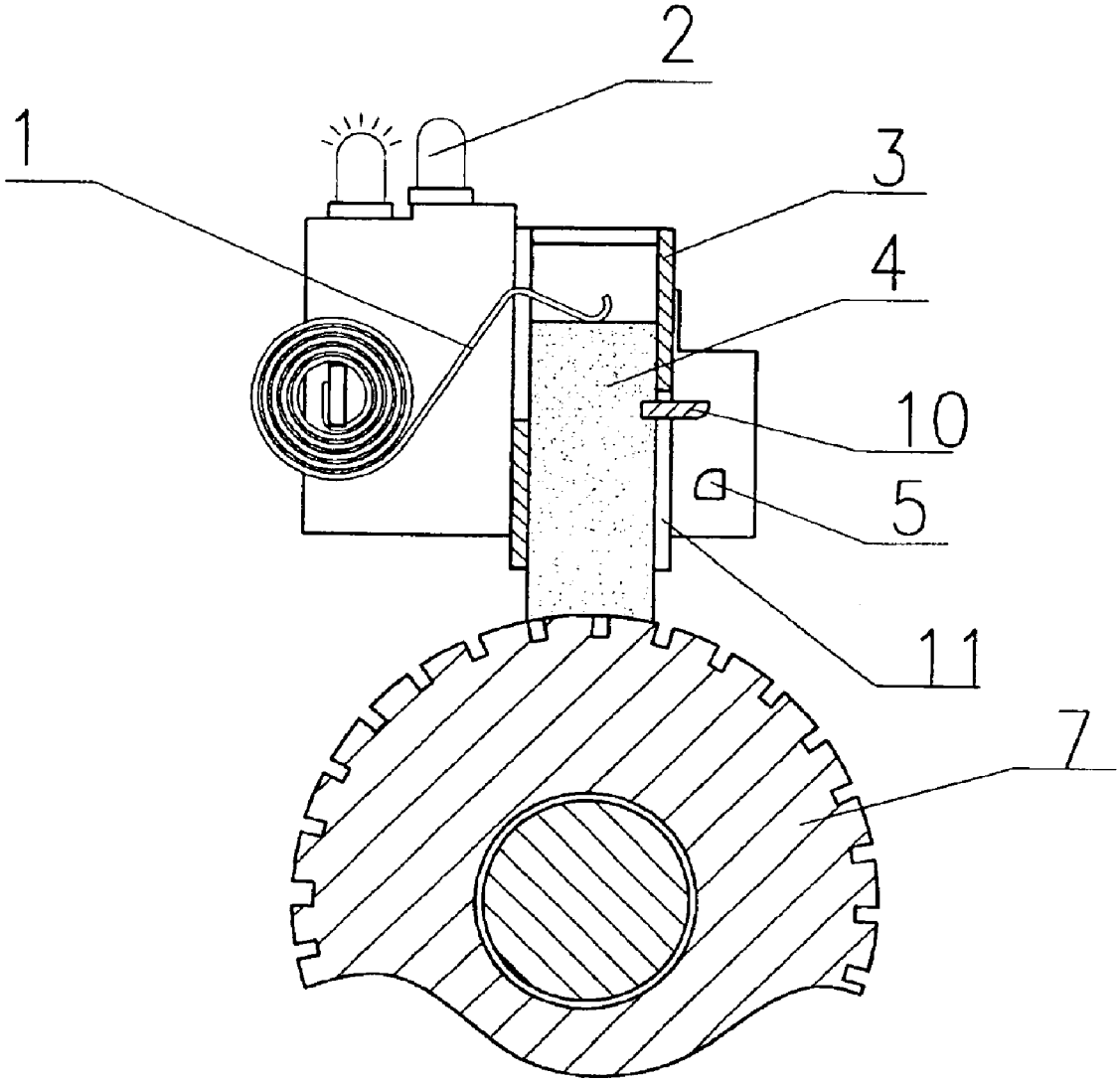
FIG. 8 shows a sectional view of a second embodiment of the present invention with the carbon brush in the first operational state.
Figure 9:
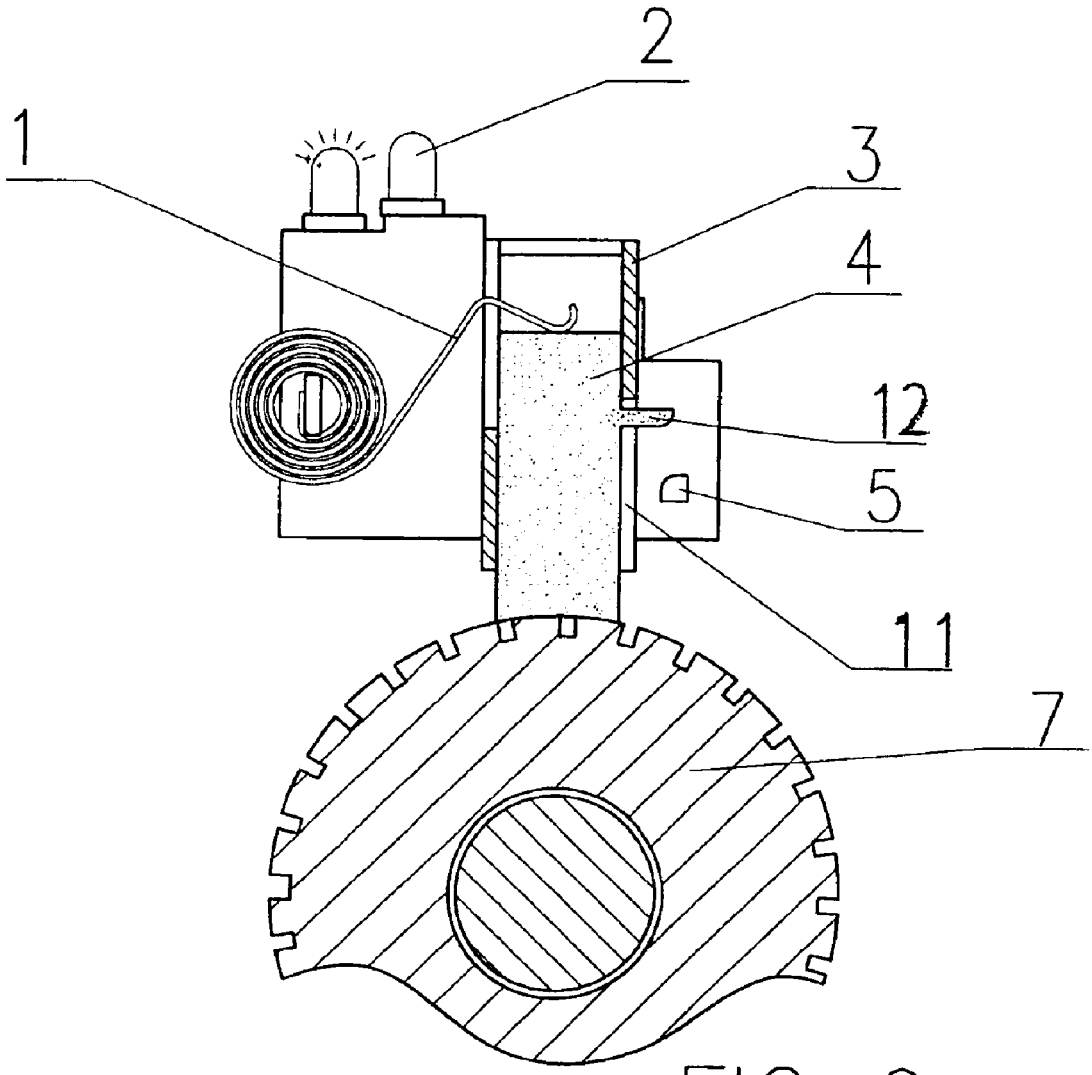
FIG. 9 shows a sectional view of a third embodiment of the present invention with the carbon brush in the first operational state

As illustrated most clearly in FIG. 5, the slot 6 is truncated (i.e., the end of the carbon brush 4 is remote from the arced end wall 9 of the slot 6) by a predetermined distance. When the arced end wall 9 of the carbon brush 4 touches the electric probe 5, the carbon brush 4 need not be displaced immediately and in fact may be used continually for a short period of time (e.g., an hour) without burning the motor.

In the second embodiment of the present invention (FIG. 8), the contact portion of the carbon brush 4 is an electrically conductive protrusion 10 made from an electrically conductive material such as a metal which protrudes from the surface of the carbon brush 4 and the housing 3. The root of the electrically conductive protrusion 10 is embedded in the carbon brush 4. The electrically conductive protrusion 10 follows the movement of the carbon brush 4 along a guiding slot 11. An electric probe 5 protrudes from the circuit board 13. The electrically conductive protrusion 10 contacts the electric probe 5 when the carbon brush 4 has moved a predetermined distance. The end face of the electrically conductive protrusion 10 and the surface of the electric probe 5 which contact each other are arced.

In the third embodiment of the present invention (FIG. 9), the contact portion of the carbon brush 4 is a protrusion 12 integrally formed on the carbon brush 4 which protrudes from the surface of the carbon brush 4 and the housing 3. The protrusion 12 follows the movement of the carbon brush 4 along a guiding slot 11. An electric probe 5 protrudes from the circuit board 13. The protrusion 12 contacts the electric probe 5 when the carbon brush 4 has moved a predetermined distance. The end face of the protrusion 12 and the surface of the electric probe 5 which contact each other are arced.

What is claimed is:

1. A wear indicator for a motor carbon brush that is used in association with a commutator having a surface comprising:

a housing;

a carbon brush slidably mounted within the housing in a sliding direction, wherein the front end of the carbon brush touches the surface of the commutator and the surface of the carbon brush has a contact portion, the contact portion comprising a protrusion protruding from the surface of the carbon brush;

a guiding slot in the housing which extends co-directionally with the sliding direction, the protrusion protruding through the guiding slot, an elastic element positioned on the housing which bears against the rear end of the carbon brush;

a circuit board which is equipped with an alarm indicator light and is fixed to the housing; and an electric probe disposed on the circuit board which is electrically connected to the alarm indicator light, the electric probe comprising a substantially columnar projection projecting from the circuit board, wherein in use when the carbon brush is in a first operational state, a surface of the electric probe is disconnected from the contact portion of the carbon brush and when the carbon brush is in a second operational state, the surface of the electric probe touches the contact portion of the carbon brush.

2. A wear indicator according to claim 1, wherein the circuit board is a substantially planar body and wherein the substantially columnar projection and the contact portion are capable of relative movement from the first operational state to the second operational state.

3. A wear indicator according to claim 2, further comprising an elongate truncated slot disposed on the surface of the carbon brush which extends co-directionally with the sliding direction, wherein the contact portion is an end portion of the elongate truncated slot and the electric probe has an end inserted freely into the elongate truncated slot.

4. A wear indicator according to claim 3, wherein the end portion of the elongate truncated slot is arced.

5. A wear indicator according to claim 1, further comprising: an elongate truncated slot disposed on the surface of the carbon brush wherein the contact portion is disposed at the end of the elongate truncated slot.

6. A wear indicator according to claim 1, wherein the substantially columnar projection has an arced surface opposing a contact surface of the protrusion wherein in use when the carbon brush is in the second operational state, the arced surface contacts the contact surface of the protrusion.

7. A wear indicator according to claim 6, wherein the contact surface of the protrusion is arced.

8. A wear indicator according to claim 1, wherein the contact portion is an electrically conductive protrusion protruding from the surface of the carbon brush whose root is embedded in the carbon brush.

9. A wear indicator according to claim 8, wherein the substantially columnar projection has an arced surface opposing a contact surface of the electrically conductive protrusion wherein in use when the carbon brush is in the second operational state, the arced surface contacts the contact surface of the electrically conductive protrusion.

10. A wear indicator according to claim 9, wherein the contact surface of the electrically conductive protrusion is arced.

11. A wear indicator as claimed in claim 1, wherein the contact portion is continuously exposed.

12. A wear indicator as claimed in claim 1, wherein the contact portion and/or the surface of the electric probe is arced.

13. A commutator motor comprising one or more wear indicators as defined in claim 1.

14. A wear indicator for a motor carbon brush that is used in association with a commutator having a surface comprising:

a housing;

a carbon brush slidably mounted within the housing in a sliding direction, the carbon brush having a front end touching the surface of the commutator;

a contact portion comprising an electrically conductive protrusion protruding from a surface of the carbon brush, the contact portion having a root embedded in the carbon brush;

a guiding slot in the housing which extends co-directionally with the sliding direction, the electrically conductive protrusion protruding through the guiding slot;

an elastic element positioned on the housing which bears against the rear end of the carbon brush;

a circuit board which is equipped with an alarm indicator light and is fixed to the housing; and an electric probe disposed on the circuit board which is electrically connected to the alarm indicator light, the electric probe comprising a substantially columnar projection projecting from the circuit board, wherein in use when the carbon brush is in a first operational state, a surface of the electric probe is disconnected from the contact portion projecting from the carbon brush and when the carbon brush is in a second operational state, the surface of the electric probe touches the contact portion projecting from the carbon brush.

15. A wear indicator according to claim 14, wherein the circuit board is a substantially planar body and wherein the substantially columnar projection and the contact portion are capable of relative movement from the first operational state to the second operational state.

16. A wear indicator according to claim 14, further comprising an elongate truncated slot disposed on the surface of the carbon brush wherein the contact portion is disposed at the end of the elongate truncated slot.

17. A wear indicator according to claim 16, further comprising an elongate truncated slot disposed on the surface of the carbon brush which extends co-directionally with the sliding direction, wherein the contact portion is an end portion of the elongate truncated slot and the electric probe has an end inserted freely into the elongate truncated slot.

18. A wear indicator according to claim 17, wherein the end portion of the elongate truncated slot is arced.

19. A wear indicator according to claim 14, wherein the substantially columnar projection has an arced surface opposing a contact surface of the electrically conductive protrusion wherein in use when the carbon brush is in the second operational state, the arced surface contacts the contact surface of the electrically conductive protrusion.

20. A wear indicator according to claim 19, wherein the contact surface of the electrically conductive protrusion is arced.

21. A wear indicator as claimed in claim 14, wherein the contact portion is continuously exposed.

22. A wear indicator as claimed in claim 14, wherein the contact portion and/or the surface of the electric probe is arced.

23. A commutator motor comprising one or more wear indicators as defined in claim 14.

* * * * *

UNITED STATES PATENT AND TRADEMARK OFFICE

CERTIFICATE OF CORRECTION

PATENT NO. : 6,933,650 B2
APPLICATION NO. : 10/754274
DATED : August 23, 2005
INVENTOR(S) : Yongfeng Wang It is certified that error appears in the above-identified patent and that said Letters Patent is hereby corrected as shown below:

Title Page
Item [57], ABSTRACT, line 7, change "need" to --needs--

Column 2
Line 64, before "comprise" remove [be]
Lines 65 and 66, change "from which is angularly dependent an arm which extends into the elongate truncated slot." to --from which an arm, which extends into the elongate truncated slot, is angularly dependent.--

Signed and Sealed this

Eighth Day of August, 2006

JON W. DUDAS
*Director of the United States Patent and Trademark Office*